US009073680B2

(12) United States Patent
Kastanek

(10) Patent No.: US 9,073,680 B2
(45) Date of Patent: Jul. 7, 2015

(54) CARTON WITH ARTICLE PROTECTION FEATURES

(71) Applicant: Graphic Packaging International, Inc., Atlanta, GA (US)

(72) Inventor: Raymond S. Kastanek, Kennesaw, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 110 days.

(21) Appl. No.: 13/833,205

(22) Filed: Mar. 15, 2013

(65) Prior Publication Data

US 2013/0292285 A1 Nov. 7, 2013

Related U.S. Application Data

(60) Provisional application No. 61/687,881, filed on May 3, 2012.

(51) Int. Cl.
*B65D 71/36* (2006.01)
*B65D 71/18* (2006.01)
(Continued)

(52) U.S. Cl.
CPC ..... *B65D 71/18* (2013.01); *B65D 5/5007* (2013.01); *B65B 5/024* (2013.01); *B65D 71/36* (2013.01); *B65D 2571/00141* (2013.01);
(Continued)

(58) Field of Classification Search
CPC ..... B65D 71/18; B65D 71/36; B65D 5/5007; B65D 2571/00141; B65D 2571/0045; B65D 2571/0066; B65D 2571/00524; B65D 2571/00271; B65D 2571/00277; B65D 2571/00728; B65B 21/24; B65B 21/5024; B65B 55/20
USPC ..... 206/427, 433, 435, 565, 593, 784, 206/145–161; 229/117.16, 117.17, 120.15, 229/120.16, 120.17, 120.18, 120.21
See application file for complete search history.

(56) References Cited

U.S. PATENT DOCUMENTS 1,803,028 A 4/1931 Menten
2,163,045 A * 6/1939 Lavere ..... 206/784
(Continued)

FOREIGN PATENT DOCUMENTS

EP 0870688 1/1998
WO WO-89/03792 A1 * 5/1989 ..... 206/145
WO WO 99/28198 10/1999

OTHER PUBLICATIONS

International Search Report and Written Opinion for related PCT application No. PCT/US2013/03198, mailed Jun. 21, 2013.

*Primary Examiner* — Gary Elkins
(74) *Attorney, Agent, or Firm* — Womble Carlyle Sandridge & Rice, LLP

(57) ABSTRACT

A carton for containing a plurality of articles. The carton comprises a plurality of panels extending at least partially around an interior of the carton. The plurality of panels comprises at least one side panel. The carton further comprises a plurality of end flaps foldably connected to a respective panel of the plurality of panels. The plurality of end flaps are configured to close an end of the carton. The plurality of end flaps comprise at least one side end flap foldably connected to the at least one side panel. The carton further comprises an article protection feature foldably connected to the at least one side end flap and moveable between a first position that is substantially parallel to the side end flap and a second position wherein the article protection feature is folded relative to the at least one side end flap.

47 Claims, 8 Drawing Sheets

(51) Int. Cl.

| | |
|---|---|
| ***B65D 5/50*** | (2006.01) |
| ***B65B 5/02*** | (2006.01) |
| ***B65B 21/24*** | (2006.01) |
| *B65B 55/20* | (2006.01) |

(52) U.S. Cl.

CPC ..... *B65D 2571/00271* (2013.01); *B65D 2571/00277* (2013.01); *B65D 2571/0045* (2013.01); *B65D 2571/00524* (2013.01); *B65D 2571/0066* (2013.01); *B65D 2571/00728* (2013.01); *B65B 21/24* (2013.01); *B65B 55/20* (2013.01)

(56) References Cited

U.S. PATENT DOCUMENTS

| | | | | | |
|---|---|---|---|---|---|
| 2,196,502 | A | | 4/1940 | Kells | |
| 2,308,050 | A | | 1/1943 | Burr | |
| 2,386,905 | A | | 10/1945 | Meitzen | |
| 2,426,865 | A | | 9/1947 | Fink | |
| 2,648,484 | A | | 8/1953 | Belsinger | |
| 2,705,556 | A | * | 4/1955 | Ringler | 206/427 |
| 2,900,123 | A | | 8/1959 | Drnec et al. | |
| 3,168,963 | A | | 2/1965 | Wolowicz | |
| 3,173,596 | A | | 3/1965 | Aust et al. | |
| 3,181,727 | A | * | 5/1965 | Graser et al. | 206/155 |
| 3,398,856 | A | * | 8/1968 | Graser | 206/148 |
| 3,660,116 | A | * | 5/1972 | Clark | 229/117.16 |
| 3,672,559 | A | * | 6/1972 | Webinger | 206/784 |
| 3,756,499 | A | | 9/1973 | Giebel et al. | |
| 4,005,815 | A | | 2/1977 | Nerenberg et al. | |
| 4,056,223 | A | | 11/1977 | Williams | |
| 4,313,540 | A | * | 2/1982 | Hart et al. | 206/784 |
| 4,328,922 | A | | 5/1982 | Hirata | |
| 4,438,843 | A | | 3/1984 | Graser | |
| 4,538,759 | A | | 9/1985 | Dutcher | |
| 4,621,766 | A | | 11/1986 | McClure | |
| 4,641,746 | A | | 2/1987 | Dornbusch et al. | |
| 4,925,019 | A | * | 5/1990 | Ganz et al. | 206/427 |
| 5,072,876 | A | | 12/1991 | Wilson | |
| 5,119,985 | A | | 6/1992 | Dawson et al. | |
| 5,350,109 | A | | 9/1994 | Brown et al. | |
| 5,372,299 | A | * | 12/1994 | Edgerton et al. | 229/120.18 |
| 5,390,784 | A | * | 2/1995 | Sutherland | 206/148 |
| 5,588,585 | A | | 12/1996 | McClure | |
| 5,657,864 | A | * | 8/1997 | Harrelson | 206/427 |
| 6,112,977 | A | | 9/2000 | Sutherland et al. | |
| 6,170,741 | B1 | | 1/2001 | Skolik et al. | |
| 6,250,542 | B1 | | 6/2001 | Negelen | |
| 6,595,411 | B2 | | 7/2003 | McClure | |
| 6,631,803 | B2 | | 10/2003 | Rhodes et al. | |
| 6,766,940 | B2 | | 7/2004 | Negelen | |
| 6,848,573 | B2 | | 2/2005 | Gould et al. | |
| 6,968,992 | B2 | | 11/2005 | Schuster | |
| 7,690,507 | B2 | | 4/2010 | Sutherland | |
| 7,757,933 | B2 | | 7/2010 | Dunn | |
| 7,775,418 | B2 | | 8/2010 | Walling | |
| 7,780,067 | B2 | | 8/2010 | Holley, Jr. | |
| 7,832,622 | B2 | | 11/2010 | Spivey, Sr. | |
| 7,984,843 | B2 | | 7/2011 | Cooper et al. | |
| 7,998,047 | B2 | | 8/2011 | Spivey, Sr. et al. | |
| 2005/0087592 | A1 | | 4/2005 | Schuster | |
| 2005/0189405 | A1 | | 9/2005 | Gomes et al. | |
| 2005/0263574 | A1 | | 12/2005 | Schuster | |
| 2006/0081691 | A1 | | 4/2006 | Smalley | |
| 2006/0278689 | A1 | | 12/2006 | Boshinski et al. | |
| 2007/0063003 | A1 | | 3/2007 | Spivey et al. | |
| 2007/0108261 | A1 | | 5/2007 | Schuster | |
| 2007/0131748 | A1 | | 6/2007 | Brand | |
| 2008/0048014 | A1 | | 2/2008 | Bates | |
| 2010/0025457 | A1 | | 2/2010 | Cooper et al. | |
| 2012/0074037 | A1 | | 3/2012 | Orischak et al. | |

* cited by examiner

CARTON WITH ARTICLE PROTECTION FEATURES

CROSS-REFERENCE TO RELATED APPLICATIONS

This application claims the benefit of U.S. Provisional Patent Application No. 61/687,881 filed May 3, 2012.

INCORPORATION BY REFERENCE

The disclosure of U.S. Provisional Patent Application No. 61/687,881, which was filed on May 3, 2012, is hereby incorporated by reference for all purposes as if presented herein in their entirety.

BACKGROUND OF THE DISCLOSURE

The present disclosure generally relates to cartons for holding beverage containers or other types of articles. More specifically, the present disclosure relates to cartons having article protection features.

SUMMARY OF THE DISCLOSURE

In general, one aspect of the disclosure is directed to a carton for containing a plurality of articles. The carton comprises a plurality of panels extending at least partially around an interior of the carton. The plurality of panels comprises at least one side panel. The carton further comprises a plurality of end flaps foldably connected to a respective panel of the plurality of panels. The plurality of end flaps are configured to close an end of the carton. The plurality of end flaps comprise at least one side end flap foldably connected to the at least one side panel. The carton further comprises an article protection feature foldably connected to the at least one side end flap and moveable between a first position that is substantially parallel to the side end flap and a second position wherein the article protection feature is folded relative to the at least one side end flap.

In another aspect, the present disclosure is generally directed to a blank for forming a carton. The blank comprises a plurality of panels comprising at least one side panel and a plurality of end flaps foldably connected to a respective panel of the plurality of panels. The plurality of end flaps are configured to close an end of a carton formed of the blank. The plurality of end flaps comprise at least one side end flap foldably connected to the at least one side panel. The blank further comprises an article protection feature foldably connected to the at least one side end flap and moveable between a first position that is substantially parallel to the side end flap and a second position wherein the article protection feature is folded relative to the at least one side end flap.

In another aspect, the present disclosure is generally directed to a method of forming a carton. The method comprises obtaining a blank. The blank comprises a plurality of panels comprising at least one side panel and a plurality of end flaps foldably connected to a respective panel of the plurality of panels. The plurality of end flaps are configured to close an end of the carton. The plurality of end flaps comprise at least one side end flap foldably connected to the at least one side panel. The blank further comprises features for forming an article protection feature foldably connected to the at least one side end flap. The method further comprises folding the plurality of panels to at least partially form an interior of the carton and positioning the article protection feature to engage at least one article. The positioning comprises moving the article protection feature from a first position that is substantially parallel to the at least one side end flap to a second position wherein the article protection feature is folded relative to the at least one side end flap.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc., and handle reinforcement features of such cartons. The articles can be used for containing food and beverage products, for example. The articles can be made from materials suitable in composition for packaging the particular food or beverage item, and the materials can include, but are not limited to, glass or other breakable material; aluminum and/or other metals; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "lower," "bottom," "upper" and "top" indicate orientations determined in relation to fully erected and upright cartons.

Figure 1:
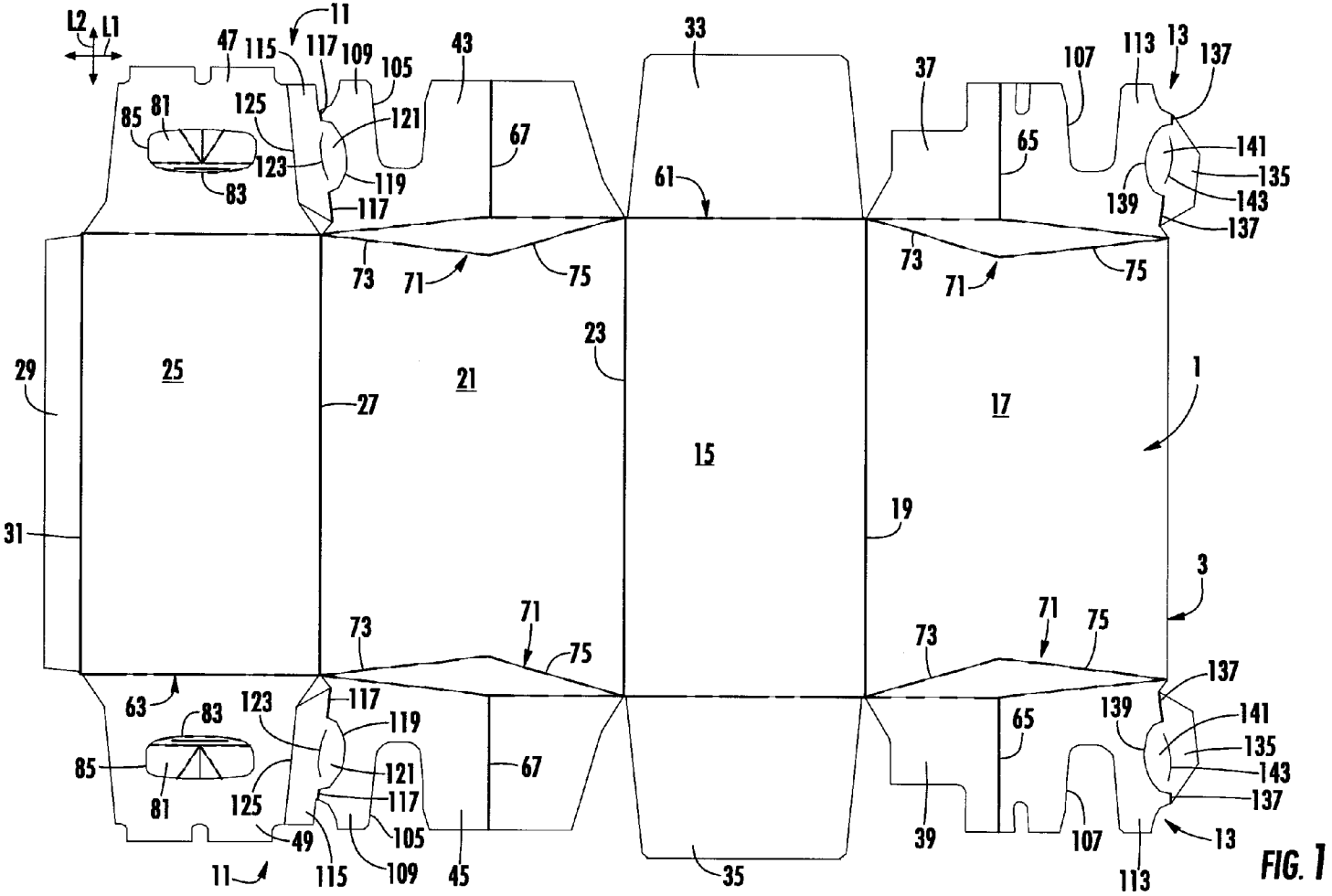
FIG. 1 is a plan view of an exterior surface of a blank of a first embodiment of the disclosure.
Figure 2:
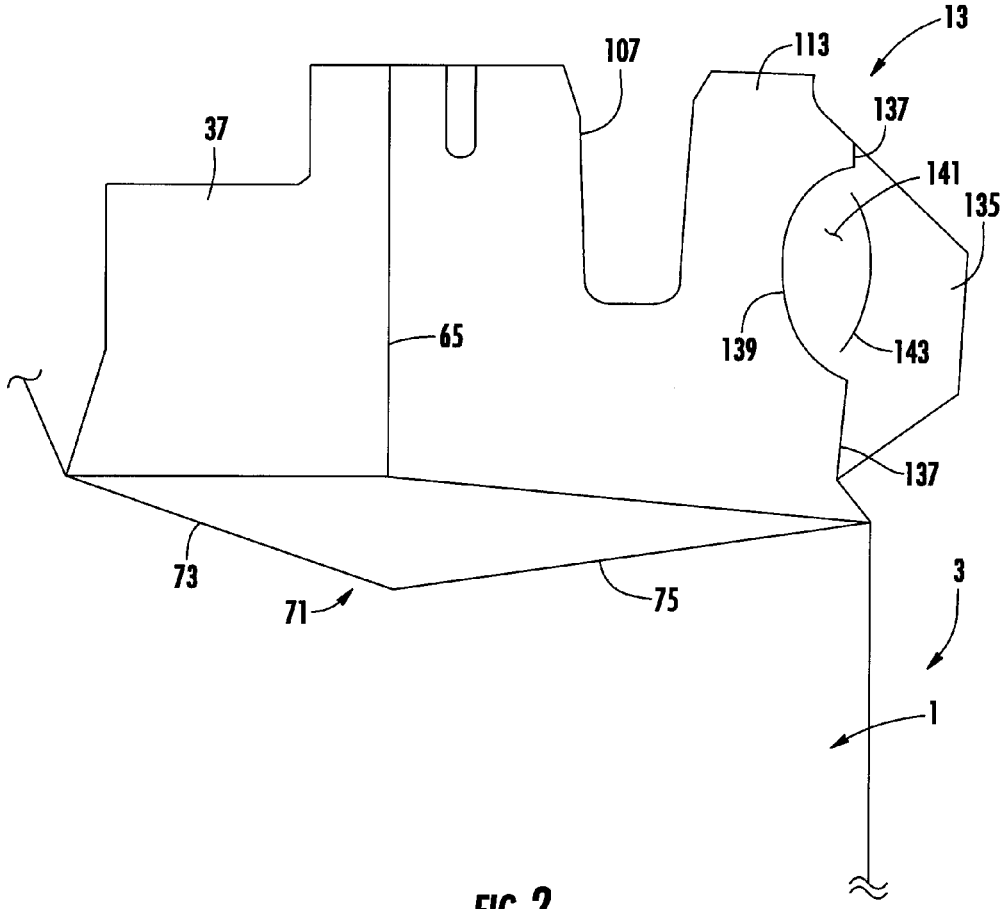
FIG. 2 is an enlarged portion of the blank of FIG. 1.
Figure 3:
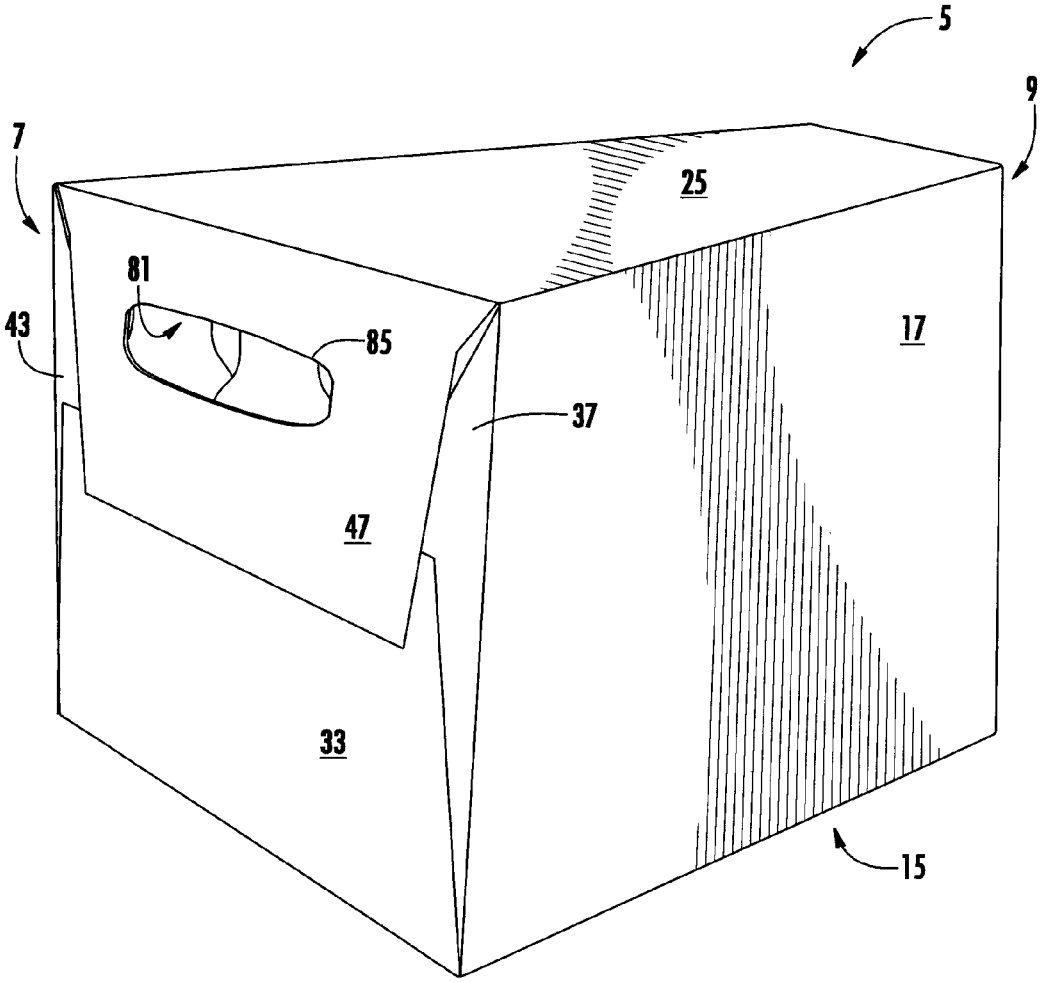
FIG. 3 is a perspective view of a carton formed from the blank of FIG. 1.
Figure 4:
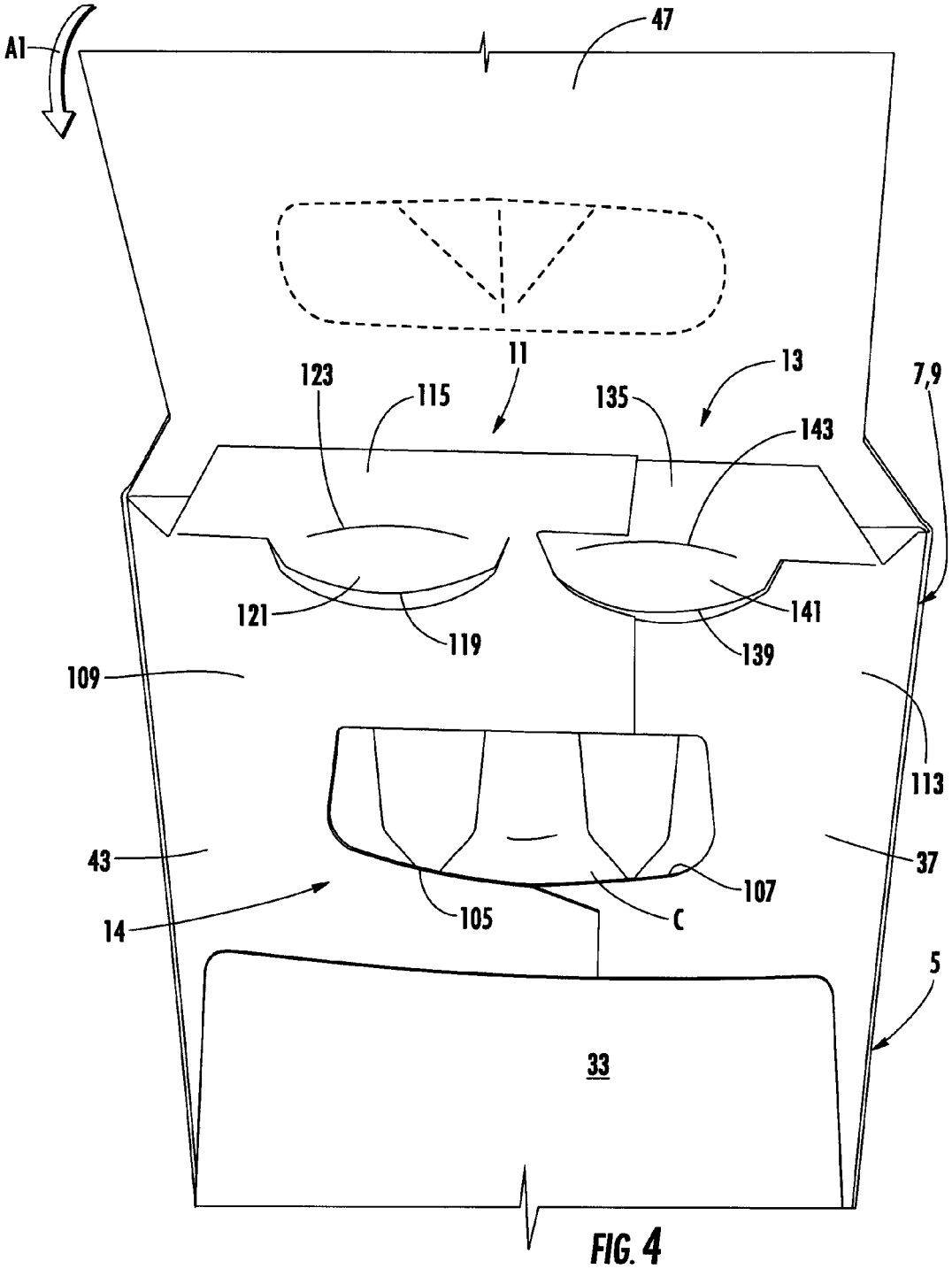
FIG. 4 is an end view of the partially formed carton of FIG. 3.
Figure 5:
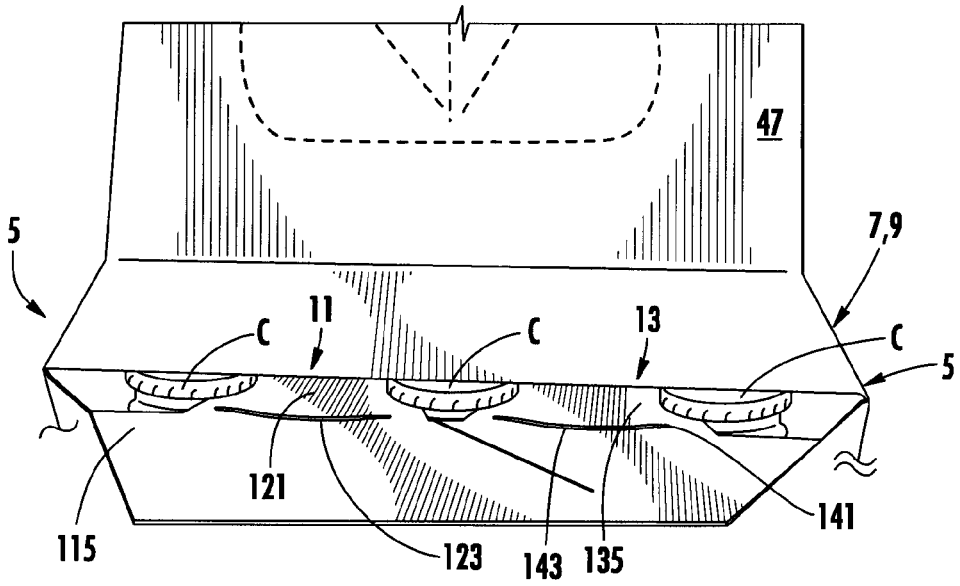
FIG. 5 is an end view showing further forming of the carton.
Figure 6:
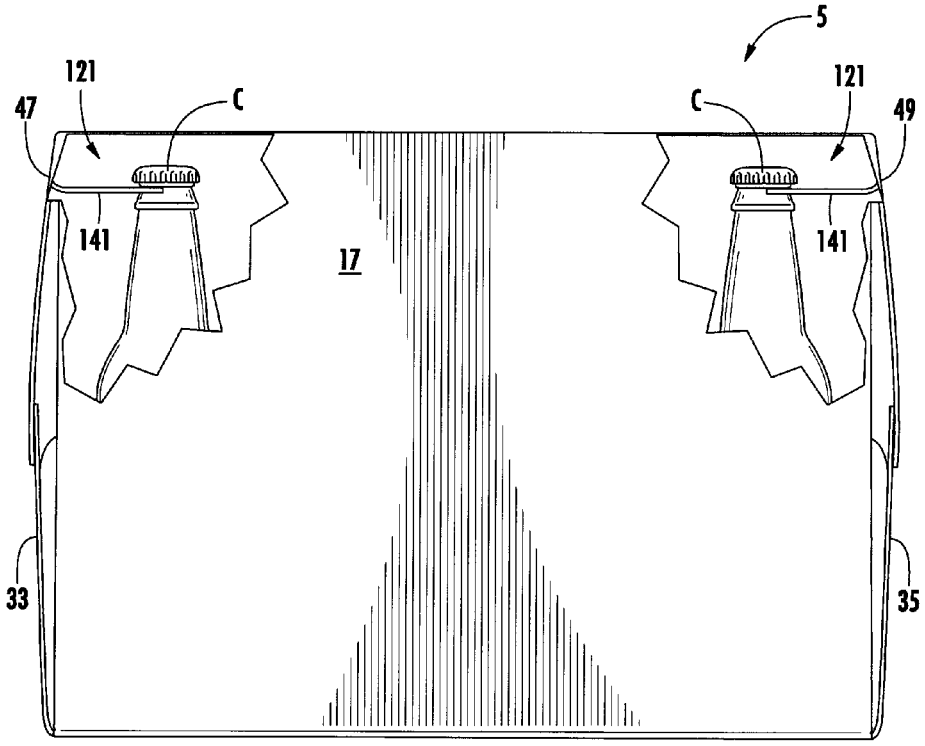
FIG. 6 is a side elevation view with a portion of the carton removed to show an interior of the carton.
Figure 7:
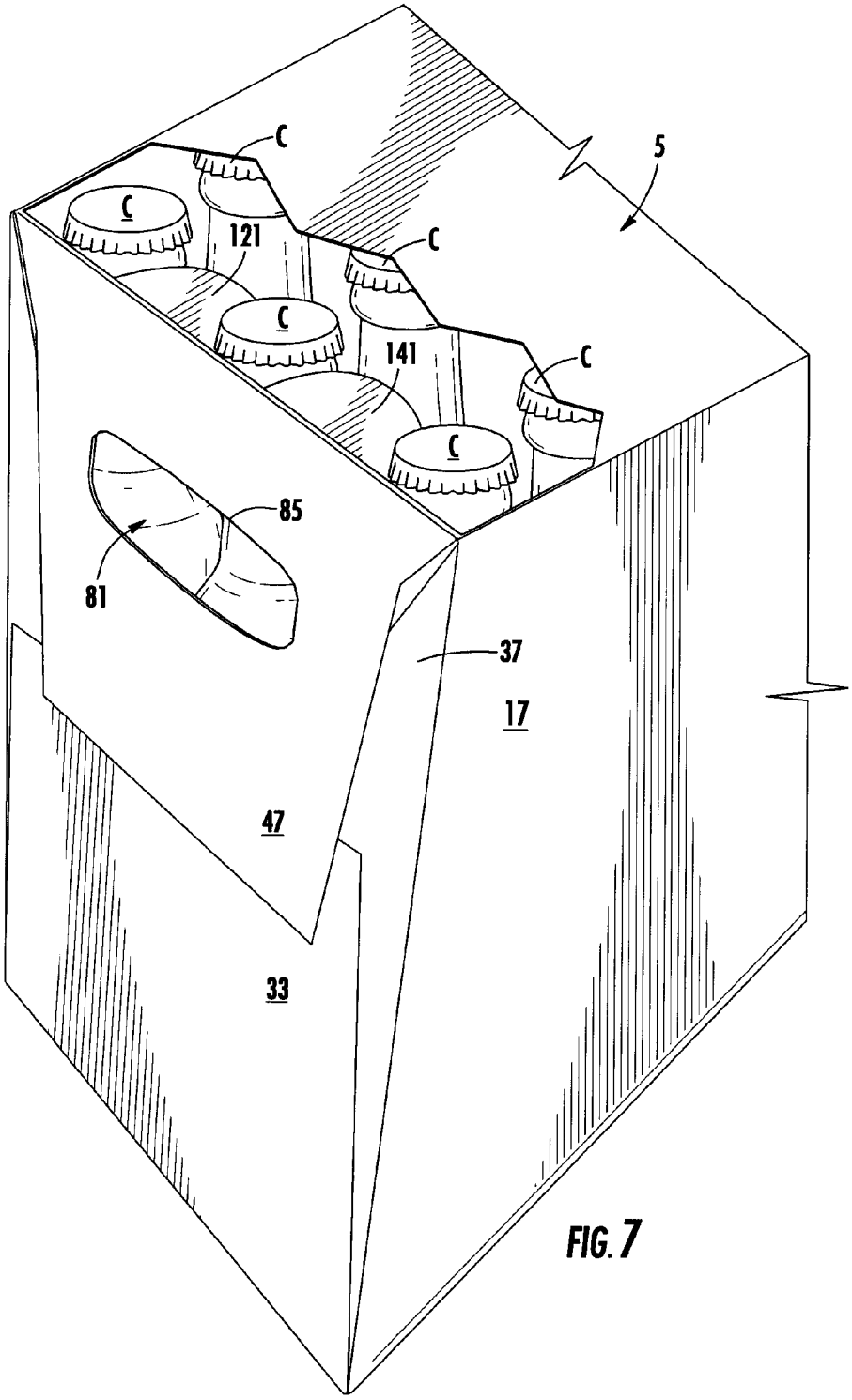
FIG. 7 is a perspective view with a portion of the carton removed to show the interior of the carton.
Figure 8:
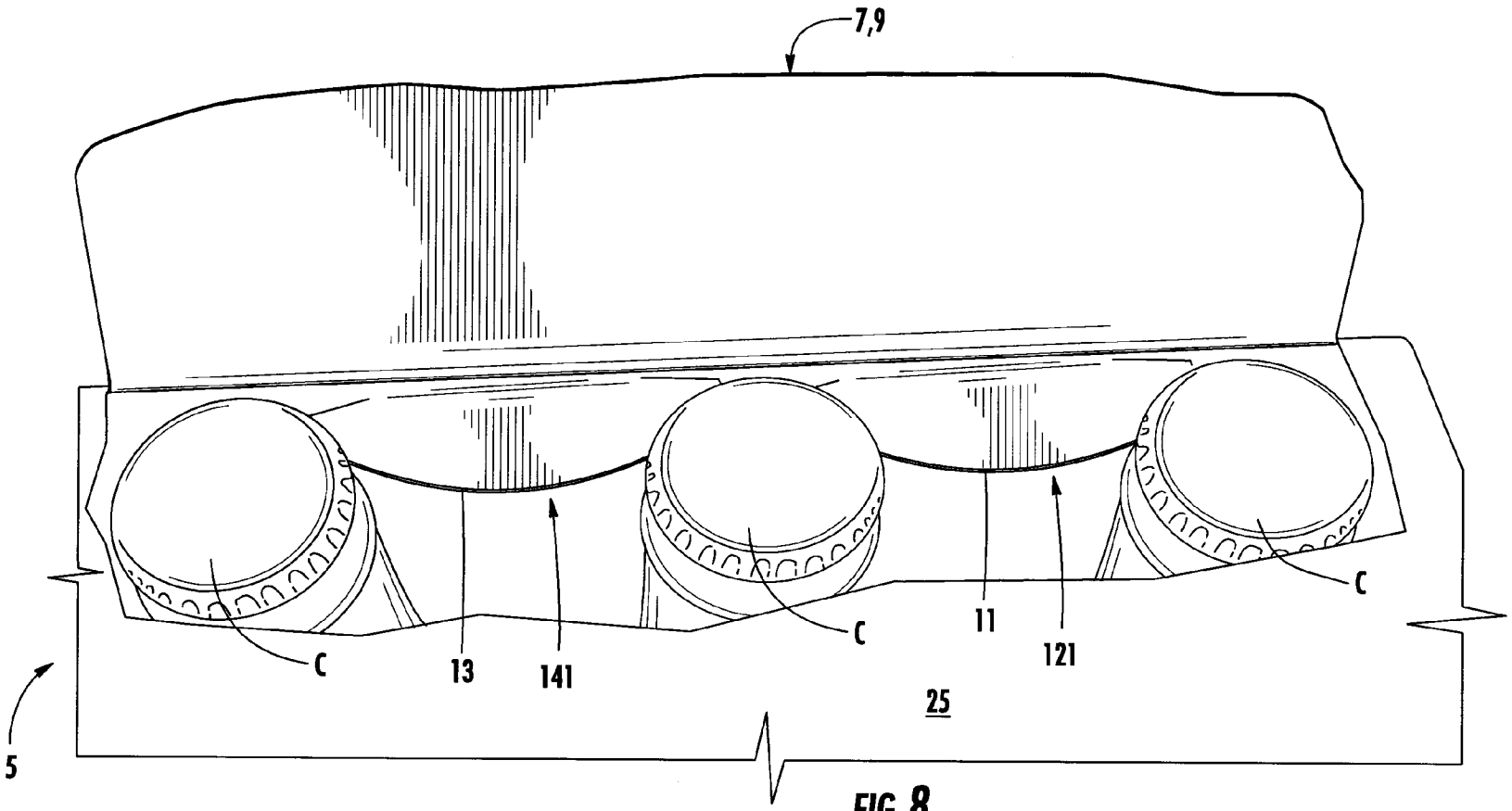
FIG. 8 is an enlarged top view with a portion of the carton removed to show the interior of the carton.

FIG. 1 is a plan view of the exterior side 1 of a blank, generally indicated at 3, used to form a carton 5 (FIGS. 3) according to one exemplary embodiment of the disclosure. The carton 5 can be used to house a plurality of articles such as containers C (FIG. 4). In the illustrated embodiment, the containers C are bottles, but the containers could be other beverage containers (e.g., cans, elongated aluminum bottles, etc.) without departing from the disclosure. In the illustrated embodiment, the carton 5 is sized to house eighteen containers C in a single layer in a 3×6 arrangement, but it is understood that the carton 5 may be sized and shaped to hold containers of a different or same quantity in more than one layer and/or in different row/column arrangements (e.g., 1×6, 2×6, 3×6, 4×5, 4×6, 3×8, 2×6×2, 3×4×2, 2×9, 3×4, etc.).

In one embodiment, the carton 5 has first and second ends 7, 9 each having article protection features 11, 13 that project into the interior of the carton to contact respective containers. In one embodiment, the article protection features 11, 13 project towards the interior of the carton from the end 7, 9 and are located between respective rows of the containers C. The carton has features for forming a handle 14 in a respective end 7, 9 of the carton, but the carton could be otherwise shaped, arranged, and/or configured without departing form the disclosure.

The blank 3 has a longitudinal axis L1 and a lateral axis L2. A bottom panel 15 is foldably connected to a first side panel 17 at a lateral fold line 19. A second side panel 21 is foldably connected to the bottom panel 15 at a lateral fold line 23. A top panel 25 is foldably connected to the second side panel 21 at a lateral fold line 27, and foldably connected to an adhesive panel 29 at a lateral fold line 31.

The bottom panel 15 is foldably connected to a first bottom end flap 33 and a second bottom end flap 35. The first side panel 17 is foldably connected to a first side end flap 37 and a second side end flap 39. The second side panel 21 is foldably connected to a first side end flap 43 and a second side end flap 45. The top panel 25 is foldably connected to a first top end flap 47 and a second top end flap 49. When the carton 5 is erected, the end flaps 33, 37, 43, 47 close the first end 7 of the carton, and the end flaps 35, 39, 45, 49 close the second end 9 of the carton. In accordance with an alternative embodiment of the present disclosure, different flap arrangements can be used for closing the ends 7, 9 of the carton 5.

The end flaps 33, 37, 43, 47 extend along a first marginal area of the blank 3, and are foldably connected at a first longitudinal fold line 61 that extends along the length of the blank. The end flaps 35, 39, 45, 49 extend along a second marginal area of the blank 3, and are foldably connected at a second longitudinal fold line 63 that also extends along the length of the blank. The longitudinal fold lines 61, 63 may be, for example, substantially straight, or offset at one or more locations to account for blank thickness or for other factors.

The blank 3 has a lateral fold line 65 extending through side end flap 37 and side end flap 39 so that each of these flaps may be folded along the fold line 65 to have an upper portion that tapers inward relative to a lower portion. A lateral fold line 67 extends through the side end flap 43 and side end flap 45 so that each of these flaps may be folded along the fold line 67 to have an upper portion that tapers inward relative to a lower portion. The blank 3 includes four diamond corners 71 formed by the portion of the fold line 61, 63 connecting a respective side panel 17, 21 to a respective end flap 37, 39, 43, 45, a first fold line 73 in a respective side panel, and a second fold line 75 in a respective side panel. The fold lines 73, 75 of the diamond corners 71 are shaped, arranged, and positioned to create a corner of the carton 5 that is in a tight fit with the container C adjacent the corner. In one embodiment, the fold lines 65, 67 allow the ends 7, 9 of the carton 5 to angle inward toward the interior of the carton 5. The diamond corners 71 could be otherwise shaped, arranged, and/or configured without departing from the disclosure.

In one embodiment, the top panel 25 of the blank 3 can have a length less than a respective length of the bottom panel 15. In the illustrated embodiment, the shorter length of the top panel 25 as compared to the bottom panel 15 causes both ends 7, 9 of the carton 5 to be shaped to contact both the top and bottom of the containers C housed in the carton to restrain the movement of the containers in the carton. The bottom panel 15 and/or top panel 25 can be otherwise shaped, arranged, and/or configured without departing from the disclosure. For example, the bottom panel 15 and top panel 25 could have a different width, and the same length, or both the same width and length without departing from the disclosure.

The blank 3 comprises features that form the handle 14 of the carton 5. In one embodiment the features include a handle flap 81 foldably connected to a respective top end flap 47, 49 at a curved fold line 83. In one embodiment, the handle flap 81 is formed by a cut or tear line 85 extending from respective ends of the fold line 83. The handle flap 81 could be otherwise shaped, arranged, and/or configured without departing from the disclosure.

The handle features of the blank 3 further comprise a notch 105 in a respective end flap 43, 45 attached to the second side panel 21 and a notch 107 in a respective end flap 37, 39 attached to the first side panel 17. The handle features comprise a portion 109 of the end flap 43, 45 above or adjacent the notch 105 and a portion 113 of the end flap 37, 39 above or adjacent the notch 107. The handle features could be otherwise shaped, arranged, and/or configured, and could have other reinforcement features without departing from the disclosure. Further, the handle 14 could be omitted without departing from the disclosure.

In the illustrated embodiment, the article protection features 11 of the blank 3 are formed in respective end flaps 43, 45 and include an article retention actuator flap 115 foldably connected to a respective portion 109 of the end flaps 43, 45 at two spaced apart, oblique fold lines 117. The article retention actuator flap 115 may be termed an actuator portion in some embodiments. In one embodiment, a curved cut 119 extends between the oblique fold lines 117 to form an article retention tab 121. A curved cut 123 is spaced apart from the curved cut 119 and forms a line of weakening that foldably connects the article retention tab 121 to the article retention actuator flap 115. The article retention tab 121 is separated from a respective top end flap 47, 49 by an oblique cut 125. The article protection features 11 could be otherwise shaped, arranged, and/or configured without departing from the disclosure.

In one embodiment, the article protection features 13 of the blank 3 are formed in respective end flaps 37, 39 and include an article retention actuator flap 135 foldably connected to a respective portion 113 of the end flaps 37, 39 at two spaced apart, oblique fold lines 137. The article retention actuator flap 135 may be termed an actuator portion in some embodiments. In one embodiment, a curved cut 139 extends between the oblique fold lines 137 to form an article retention tab 141. A curved cut 143 is spaced apart from the curved cut 139 and forms a line of weakening that foldably connects the article retention tab 141 to the article retention actuator flap 135. The article protection features 13 could be otherwise shaped, arranged, and/or configured without departing from the disclosure.

As shown in FIGS. 4-8, one exemplary method of forming the carton 5 from the blank 3 is shown. The adhesive panel 29 is adhesively attached to a marginal portion of the first side panel 17 and the blank 3 is formed into a generally open-ended sleeve and loaded with containers C. In one embodiment, one end 7, 9 of the sleeve or partially formed carton 5 can be closed prior to inserting the containers into the sleeve. In the illustrated embodiment, the closing of one end 7, 9 is shown and described, but the opposite end of the carton 5 is closed in a similar manner. In the illustrated embodiment, the handle 14 in each end 7, 9 is formed upon folding the end flaps closing a respective end of the carton 5 and the article protection features 11, 13 are activated and positioned to retain a respective container C upon folding of the end flaps closing a respective end of the carton.

As shown in FIGS. 4-8, after the containers C are loaded, the end flaps 33, 37, 43, 47 can be at least partially overlapped to close the end 7 of the carton 5 and form the article protection features 11, 13 and the handle 14 at the end 7. Although, the closing of only one end 7, 9 of the carton may be shown and/or described herein, it is understood that the other end 7, 9 can be closed in a similar manner such that the handle 14 is formed and the article protection features are formed. As shown in FIG. 4, the end flap 37 is first folded about the fold line 61 to partially close the end 7 of the carton 5 and then the end flap 43 is folded about fold line 61 to partially overlap the end flap 37. In one embodiment, a portion of the article retention flap 115 overlaps a portion of the article retention flap 135, and the portion 109 of the end flap 43 above the notch 105 at least partially overlaps the portion 113 of the end flap 37 above the notch 107 to reinforce the handle 14. From the position of FIG. 4, the top end flap 47 is downwardly folded in the direction of arrow A1 with the article retention actuator flaps 115, 135 being downwardly folded by contact with the top end flap 47. As the article retention actuator flaps 115, 135 are downwardly folded, the article retention tabs 121, 141 are actuated to be generally orthogonal to the end flaps 37, 43 so the article retention tabs 121, 141 project inwardly from the end 7, 9 to be between adjacent rows of containers C. Thus, the article protection features 11, 13 are moveable between at least two positions, a first position that is substantially parallel to the side end flap 37, 43 and a second position wherein the article protection features are folded relative to the side end flap. The article retention tabs 121, 141 pivot at fold lines 117, 137 when moved to the second position to engage a respective container C. The article retention actuator flaps 115, 135 are folded to be in face-to-face contact with the respective portions 109, 113 of the end flaps 37, 43 above the notches 105, 107. With the ends fully closed (e.g., the top end flap fully closed and folded in the direction of arrow A1), the handle 14 is reinforced and the article retention tabs 121, 141 of the article protection features 11, 13 contact a respective container C to create a tight fit of the containers in the carton. The article protection features 11, 13 reduce the amount of movement of the containers C in the carton 5 and reduce breakage or damage of the containers resulting from impact forces on the carton. The article retention tabs 121, 141 are shaped to contact two adjacent containers C at a respective end 7, 9 of the carton, but the article retention tabs could be otherwise shaped, arranged, and/or configured (e.g., to contact one container or more than two containers) without departing from the scope of this disclosure.

The cartons 5 of any of the illustrated or non-illustrated embodiments of the disclosure could have other features (e.g., dispenser features, handle features, reinforcement features, etc.) without departing from the disclosure. Also, the cartons 5 could be otherwise shaped, arranged, or configured and the cartons could be configured to hold articles other than beverage containers C without departing from the disclosure.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for carrying a plurality of articles, comprising:

a plurality of panels extending at least partially around an interior of the carton, the plurality of panels comprises at least one side panel;

a plurality of end flaps, each of the plurality of end flaps are foldably connected to a respective panel of the plurality of panels, the plurality of end flaps being configured to close an end of the carton, the plurality of end flaps comprise at least one side end flap foldably connected to the at least one side panel; and an article protection feature foldably connected to the at least one side end flap and moveable between a first position that is substantially parallel to the at least one side end flap and a second position wherein the article protection feature is folded relative to the at least one side end flap, the article protection feature comprises an article retention tab foldably connected to the at least one side end flap and configured to engage at least one article of the plurality of articles, and an actuator portion extending from the article retention tab for initiating movement of the article protection feature from the first position to the second position, the plurality of panels comprises a top panel and the plurality of end flaps comprises a top end flap foldably connected to the top panel, the top end flap being in face-to-face contact with the actuator portion of the article protection feature.

2. The carton of claim 1, wherein the article retention tab is generally orthogonal relative to the actuator portion.

3. The carton of claim 1, wherein the contact of the top end flap with the actuator portion of the article protection feature initiates movement of the article protection feature from the first position to the second position.

4. The carton of claim 1, wherein the article retention tab is defined by an arcuate cut in the at least one side end flap.

5. The carton of claim 4, wherein the article retention tab is foldably connected to the at least one side end flap by two spaced apart fold lines, the fold lines extending from respective ends of the arcuate cut.

6. The carton of claim 1, wherein the article protection feature further comprises a line of weakening that foldably connects the actuator portion and the article retention tab.

7. The carton of claim 1, wherein the plurality of end flaps is a first plurality of end flaps at a first end of the carton, the at least one side end flap is a first side end flap, the article protection feature is a first article protection feature, the carton comprises a second plurality of end flaps, each of the second plurality of end flaps are foldably connected to a respective panel of the plurality of panels and configured to close a second end of the carton, the second plurality of end flaps comprises a second side end flap foldably connected to the at least one side panel, the carton comprises a second article protection feature foldably connected to the second side end flap and moveable between a first position that is substantially parallel to the second side end flap and a second position wherein the second article protection feature is folded relative to the second side end flap.

8. The carton of claim 7, wherein the first article protection feature engages a first article of the plurality of articles adjacent the first end and the second article protection feature engages a second article of the plurality of articles adjacent the second end.

9. The carton of 8, wherein the first article protection feature and the second article protection feature each comprises an article retention tab foldably connected to a respective one of the first side end flap and the second side end flap, the article retention tab configured to engage a respective one of the first article and the second article.

10. The carton of claim 9 wherein the first article protection feature and the second article protection feature each comprises an actuator portion extending from a respective article retention tab for initiating movement of a respective one of the first article protection feature and the second article protection feature to the second position.

11. The carton of claim 10, wherein the article retention tab is generally orthogonal relative to the actuator portion.

12. The carton of claim 11, wherein the plurality of panels comprises a top panel and the first plurality of end flaps comprises a first top end flap foldably connected to the top panel and the second plurality of end flaps comprises a second top end flap foldably connected to the top panel, the first top end flap being in face-to-face contact with the actuator portion of the first article protection feature and the second top end flap being in face-to-face contact with the actuator portion of the second article protection feature.

13. The carton of claim 12 wherein the contact of the first top end flap with the actuator portion of the first article protection feature initiates movement of the first article protection feature from the first position to the second position and the contact of the second top end flap with the actuator portion of the second article protection feature initiates movement of the second article protection feature from the first position to the second position.

14. The carton of claim 1, wherein the at least one side panel is a first side panel, the plurality of panels comprises a second side panel, the at least one side end flap is a first side end flap and the plurality of end flaps comprises a second side end flap foldably connected to the second side panel, the article protection feature is a first article protection feature, the carton comprises a second article protection feature foldably connected to the second side end flap and moveable between a first position that is substantially parallel to the second side end flap and a second position wherein the second article protection feature is folded relative to the second side end flap.

15. The carton of claim 14, wherein the first article protection feature engages at least one article of the plurality of articles and the second article protection feature engages the at least one article.

16. The carton of claim 14, wherein the first article protection feature engages a first article of the plurality of articles adjacent the closed end and the second article protection feature engages a second article of the plurality of articles adjacent the closed end.

17. The carton of 14, wherein the first article protection feature and the second article protection feature each comprises an article retention tab foldably connected to a respective one of the first side end flap and the second side end flap, the article retention tab configured to engage at least one article of the plurality of articles.

18. The carton of claim 17, wherein the first article protection feature and the second article protection feature each comprises a respective actuator portion extending from a respective article retention tab for initiating movement of a respective one of the first article protection feature and the second article protection feature to the second position.

19. The carton of claim 18, wherein the plurality of panels comprises a top panel and the plurality of end flaps comprises a top end flap foldably connected to the top panel, the top end flap being in face-to-face contact with the actuator portion of the first article protection feature and the second article protection feature.

20. The carton of claim 19 wherein the contact of the top end flap with the actuator portion of the first article protection feature and the second article protection feature initiates movement of the first article protection feature and the second article protection feature from the first position to the second position.

21. A carton for carrying a plurality of articles, comprising:

a plurality of panels extending at least partially around an interior of the carton, the plurality of panels comprises at least one side panel;

a plurality of end flaps, each of the plurality of end flaps are foldably connected to a respective panel of the plurality of panels, the plurality of end flaps being configured to close an end of the carton, the plurality of end flaps comprise at least one side end flap foldably connected to the at least one side panel; and an article protection feature foldably connected to the at least one side end flap and moveable between a first position that is substantially parallel to the at least one side end flap and a second position wherein the article protection feature is folded relative to the at least one side end flap, the article protection feature comprises an article retention tab foldably connected to the at least one side end flap and configured to engage at least one article of the plurality of articles, and an actuator portion extending from the article retention tab for initiating movement of the article protection feature from the first position to the second position, the article protection feature further comprises a line of weakening that foldably connects the actuator portion and the article retention tab, wherein the line of weakening is a curved line of weakening spaced apart from an arcuate cut.

22. A carton for carrying a plurality of articles, comprising:

a plurality of panels extending at least partially around an interior of the carton, the plurality of panels comprises at least one side panel;

a plurality of end flaps, each of the plurality of end flaps are foldably connected to a respective panel of the plurality of panels, the plurality of end flaps being configured to close an end of the carton, the plurality of end flaps comprise at least one side end flap foldably connected to the at least one side panel; and an article protection feature foldably connected to the at least one side end flap and moveable between a first position that is substantially parallel to the at least one side end flap and a second position wherein the article protection feature is folded relative to the at least one side end flap, the at least one side panel is a first side panel, the plurality of panels comprises a second side panel, the at least one side end flap is a first side end flap and the plurality of end flaps comprises a second side end flap foldably connected to the second side panel, the article protection feature is a first article protection feature, the carton comprises a second article protection feature foldably connected to the second side end flap and moveable between a first position that is substantially parallel to the second side end flap and a second position wherein the second article protection feature is folded relative to the second side end flap, the first article protection feature and the second article protection feature each comprises an article retention tab foldably connected to a respective one of the first side end flap and the second side end flap, each article retention tab is configured to engage at least one article of the plurality of articles, the first article protection feature and the second article protection feature each comprises a respective actuator portion extending from a respective article retention tab for initiating movement of a respective one of the first article protection feature and the second article protection feature to the second position, wherein each article retention tab is generally orthogonal relative to the respective actuator portion.

23. A blank for forming a carton for containing a plurality of articles, comprising:

a plurality of panels comprising at least one side panel;

a plurality of end flaps, each of the plurality of end flaps are foldably connected to a respective panel of the plurality of panels, the plurality of end flaps being configured to close an end of a carton formed of the blank, the plurality of end flaps comprise at least one side end flap foldably connected to the at least one side panel; and features for forming an article protection feature foldably connected to the at least one side end flap and moveable between a first position that is substantially parallel to the at least one side end flap and a second position wherein the article protection feature is folded relative to the at least one side end flap, the features for forming the article protection feature comprise an article retention tab foldably connected to the at least one side end flap, the article retention tab is configured to engage at least one article of the plurality of articles, the features for forming the article protection feature comprise an actuator portion extending from the article retention tab for initiating movement of the article protection feature from the first position to the second position, the plurality of panels comprises a top panel and the plurality of end flaps comprises a top end flap foldably connected to the top panel, the top end flap for being in face-to-face contact with the actuator portion of the article protection feature.

24. The blank of claim 23, wherein the contact of the top end flap with the actuator portion of the article protection feature initiates movement of the article protection feature from the first position to the second position.

25. The blank of claim 23, wherein the article retention tab is defined by an arcuate cut in the at least one side end flap.

26. The blank of claim 25, wherein the article retention tab is foldably connected to the at least one side end flap by two spaced apart fold lines, the fold lines extending from respective ends of the arcuate cut.

27. The blank of claim 23, wherein the article protection feature further comprises a line of weakening that foldably connects the actuator portion and the article retention tab.

28. The blank of claim 23, wherein the plurality of end flaps is a first plurality of end flaps for closing a first end of a carton from the blank, the at least one side end flap is a first side end flap, the article protection feature is a first article protection feature, the blank comprises a second plurality of end flaps, each of the second plurality of end flaps are foldably connected to a respective panel of the plurality of panels and configured to close a second end of the carton formed from the blank, the second plurality of end flaps comprises a second side end flap foldably connected to the at least one side panel, the blank comprises features for forming a second article protection feature foldably connected to the second side end flap and moveable between a first position that is substantially parallel to the second side end flap and a second position wherein the second article protection flap is folded relative to the second side end flap.

29. The blank of claim 28, wherein the first article protection feature is for engaging a first article of the plurality of articles adjacent the first end and the second article protection feature is for engaging a second article of the plurality of articles adjacent the second end.

30. The blank of 29, wherein the features for forming first article protection feature and the second article protection feature each comprise an article retention tab foldably connected to a respective one of the first side end flap and the second side end flap, the article retention tab configured to engage a respective one of the first article and the second article.

31. The blank of claim 30 wherein the features for forming the first article protection feature and the second article protection feature each comprise an actuator portion extending from the article retention tab for initiating movement of a respective one of the first article protection feature and the second article protection feature to the second position.

32. The blank of claim 31, wherein the plurality of panels comprises a top panel and the first plurality of end flaps comprises a first top end flap foldably connected to the top panel and the second plurality of end flaps comprises a second top end flap foldably connected to the top panel, the first top end flap for being in face-to-face contact with the actuator portion of the first article protection feature and the second top end flap for being in face-to-face contact with the actuator portion of the second article protection feature.

33. The blank of claim 32 wherein the contact of the first top end flap with the actuator portion of the first article protection feature initiates movement of the first article protection feature from the first position to the second position and the contact of the second top end flap with the actuator portion of the second article protection feature initiates movement of the second article protection feature from the first position to the second position.

34. The blank of claim 23, wherein the at least one side panel is a first side panel, the plurality of panels comprises a second side panel, the at least one side end flap is a first side end flap and the plurality of end flaps comprises a second side end flap foldably connected to the second side panel, the article protection feature is a first article protection feature, the blank comprises features for forming a second article protection feature foldably connected to the second side end flap and moveable between a first position that is substantially parallel to the second side end flap and a second position wherein the second article protection feature is folded relative to the second side end flap.

35. The blank of claim 34, wherein the first article protection feature is for engaging at least one article of the plurality of articles and the second article protection feature is for engaging the at least one article.

36. The blank of claim 34, wherein the first article protection feature is for engaging a first article of the plurality of articles adjacent the closed end and the second article protection feature engages a second article of the plurality of articles adjacent the closed end.

37. The blank of 34, wherein the features for forming the first article protection feature and the second article protection feature each comprise an article retention tab foldably connected to a respective one of the first side end flap and the second side end flap, the article retention tab configured to engage at least one article of the plurality of articles.

38. The blank of claim 37, wherein the features for forming the first article protection feature and the second article protection feature each comprise an actuator portion extending from the article retention tab for initiating movement of a respective one of the first article protection feature and the second article protection feature to the second position.

39. The blank of claim 38, wherein the plurality of panels comprises a top panel and the plurality of end flaps comprises a top end flap foldably connected to the top panel, the top end flap for being in face-to-face contact with the actuator portion of the first article protection feature and the second article protection feature.

40. A blank for forming a carton for containing a plurality of articles, comprising:

a plurality of panels comprising at least one side panel;

a plurality of end flaps, each of the plurality of end flaps are foldably connected to a respective panel of the plurality of panels, the plurality of end flaps being configured to close an end of a carton formed of the blank, the plurality of end flaps comprise at least one side end flap foldably connected to the at least one side panel; and features for forming an article protection feature foldably connected to the at least one side end flap and moveable between a first position that is substantially parallel to the at least one side end flap and a second position wherein the article protection feature is folded relative to the at least one side end flap, the features for forming the article protection feature comprise an article retention tab foldably connected to the at least one side end flap, the article retention tab configured to engage at least one article of the plurality of articles, the article protection feature further comprises a line of weakening that foldably connects the actuator portion and the article retention tab, wherein the line of weakening is a curved line of weakening spaced apart from an arcuate cut.

41. A method of forming a carton, comprising:

obtaining a blank comprising a plurality of panels comprising at least one side panel, a plurality of end flaps, each of the plurality of end flaps are foldably connected to a respective panel of the plurality of panels, the plurality of end flaps being configured to close an end of the carton, the plurality of end flaps comprise at least one side end flap foldably connected to the at least one side panel, features for forming an article protection feature foldably connected to the at least one side end flap;

folding the plurality of panels to at least partially form an interior of the carton; and positioning the article protection feature to engage at least one article, the positioning comprising moving the article protection feature from a first position that is substantially parallel to the at least one side end flap to a second position wherein the article protection feature is folded relative to the at least one side end flap, the article protection feature comprises an article retention tab foldably connected to the at least one side end flap, the method further comprising positioning the article retention tab to engage the at least one article, the article protection feature comprises an actuator portion extending from the article retention tab for initiating movement of the article protection feature from the first position to the second position, the plurality of panels comprises a top panel and the plurality of end flaps comprises a top end flap foldably connected to the top panel, the method further comprising positioning the top end flap in face-to-face contact with the actuator portion of the article protection feature.

42. The method of claim 41, further comprising positioning the article retention tab generally orthogonal relative to the actuator portion.

43. The method of claim 41, further comprising initiating movement of the article protection feature from the first position to the second position through the contact of the top end flap with the actuator portion of the article protection feature.

44. The method of claim 41, wherein the article retention tab is defined by an arcuate cut in the at least one side end flap.

45. The method of claim 44, wherein the article retention tab is foldably connected to the at least one side end flap by two spaced apart fold lines, the fold lines extending from respective ends of the arcuate cut, the positioning the article protection feature comprises pivoting the article retention tab at the two spaced apart fold lines.

46. The method of claim 41, wherein the article protection feature further comprises a line of weakening that foldably connects the actuator portion and the article retention tab.

47. The method of claim 46, wherein the line of weakening is a curved line of weakening spaced apart from an arcuate cut.

* * * * *